US005366699A

United States Patent [19]

Milfeld et al.

[11] Patent Number: 5,366,699

[45] Date of Patent: Nov. 22, 1994

[54] APPARATUS FOR THERMAL DESTRUCTION OF WASTE

[75] Inventors: Leslie R. Milfeld, Fontana, Calif.; Keith J. Goodrich, Guanaba, Australia

[73] Assignees: Bonnie June Goodrich; Keith Joseph Goodrich, Guanaba, Australia

[21] Appl. No.: 125,402

[22] Filed: Sep. 22, 1993

[51] Int. Cl.[5] ..... B01D 53/34

[52] U.S. Cl. ..... 422/169; 239/424.5; 422/172; 422/176; 422/182; 422/200; 431/5; 431/354

[58] Field of Search ..... 422/184, 168–169, 422/172–173, 176, 182, 198, 200, 234; 431/5, 354, 353, 350; 239/424.5, 427.3, 132, 132.1, 132.3, 416.5; 60/261

[56] References Cited

U.S. PATENT DOCUMENTS

| | | | |
|---|---|---|---|
| 3,545,903 | 12/1970 | McCullough | 239/424.5 X |
| 3,607,119 | 9/1971 | Nesbitt et al. | 431/5 X |
| 3,893,810 | 7/1975 | Lientz | 422/182 X |
| 3,993,449 | 11/1976 | Childs | 431/5 X |
| 4,145,979 | 3/1979 | Lilley et al. | 110/210 |
| 4,635,568 | 1/1987 | Angelo, II | 431/5 X |
| 4,857,075 | 8/1989 | Lipp | 239/424.5 X |

*Primary Examiner*—Robert J. Warden
*Assistant Examiner*—Krisanne M. Thornton
*Attorney, Agent, or Firm*—Frank J. Dykas; Craig M. Korfanta

[57] ABSTRACT

An apparatus for the thermal destruction of waste which includes an afterburner assembly for removing pollutants from industrial waste streams by high temperature thermal destruction using a mixture of gas and gaseous hydrocarbons which is injected into the combustion chamber of the assembly using a ring injector assembly of novel construction.

20 Claims, 6 Drawing Sheets

APPARATUS FOR THERMAL DESTRUCTION OF WASTE

BACKGROUND OF THE INVENTION

1. Field of the Invention

The present invention relates generally to an apparatus for the thermal destruction of waste. More particularly, the invention concerns a novel afterburner apparatus for removing pollutants from bio-medical and industrial waste streams by high temperature thermal destruction, optionally using hydroxy gas, in lieu of atmospheric air.

DISCUSSION OF THE INVENTION

Industries throughout the world have come under increasing regulatory pressure to limit the quantities of pollutants discharged to the surrounding environments. Of particular concern is the removal from industrial waste streams of priority pollutants such as polyaromatic hydrocarbons (PAH), pesticides, heavy metals, volatile organic compounds (VOC), and PCB, to name but a few. The thrust of the present invention is to remove these priority pollutants from gaseous emissions by high temperature thermal destruction, optionally using hydroxy gas, that is, a gaseous mixture of hydrogen and oxygen mixed with natural gas, or other fuels.

While the use of hydroxy gas to accomplish high temperature burning is not new, the use of this gas in a closely controlled environment for the highly efficient thermal destruction of priority pollutants presents heretofore largely unexplored possibilities.

SUMMARY OF THE INVENTION

The apparatus of the present invention comprises a novel burner and assembly of unique configuration of chambers within which waste and gaseous emissions are thermally destroyed.

In the simplest form, the invention comprises a water cooled burner having inlet means of injecting hydrocarbon fuel, hydrogen and oxygen as a primary burner for ignition and heating of wastes to reduce them to gas and ash in a Primary Combustion Chamber suited to the purpose.

The first injection means is a novel design comprising an annular-shaped injector member having a circumferentially extending first dual water circulating passageways for circulating cooling water through the injector member.

At first, circumferentially extending triple gas passageways for directing the flow of fuel gas, hydrogen and oxygen around the injector member and plurality of circumferentially spaced angularly inwardly extending first gas passageways in communication with each of the first circumferentially extending gas passageways for directing the flow of the mixture of the hydrocarbon gas, hydrogen and oxygen inwardly of said injector member in a generally conically shaped pattern.

The assembly also includes ignition means for igniting the mixture of hydrocarbon gas, hydrogen and oxygen, whereby waste introduced into said Primary Combustion Chamber is pyrolyzed to produce waste gas which is removed through an outlet port.

Sensing means are provided for sensing temperatures within the Primary Combustion Chamber and sensing means may be provided for sensing the level of contaminates contained within the pyrolyzed waste gas.

A slightly more complex form of the invention includes a Secondary (after burner) Combustion Chamber of unique configuration disposed between the Primary Combustion Chamber and the outlet port for receiving gases flowing from said Primary Combustion Chamber along a flow path extending between said Primary and Secondary Chamber.

After burner/secondary injection means are connected to the Secondary Combustion Cheer for controlled injecting into the Secondary Combustion Chamber selected gases to enhance thermal destruction of contaminates contained within the gas flowing into the Secondary Combustion Chamber.

Provision is also made for recirculating still contaminated gases back through the secondary chamber, if necessary, including injection of selected particulate particles to further enhance destruction of contaminates.

With this summary description of the apparatus of the invention in mind, it is an object of the present invention to provide a novel apparatus for removing contaminates from industrial waste stress by thermal destruction in which contaminated waste emission gases are controllably intermixed with hydroxy gas and natural gas and the mixture thus formed ignited in the absence of air within combustion cheers of unique design.

Another object of the invention is to provide an apparatus of the aforementioned character in which the gaseous mixture is controllably introduced into the combustion chambers in a manner to optimize the safe and complete destruction of the contaminates.

Another object of the invention is to provide an apparatus as described in the preceding paragraph in which the injector assembly used to inject the gases into the combustion chamber is uniquely cooled.

Still another object of the invention is to provide an apparatus in which the injector assembly is uniquely designed to cause the gaseous mixture to flow along a predetermined conical shaped path thereby ensuring highly efficient and effective combustion.

Another object of the invention is to provide an apparatus comprising a plurality of interconnected system components of unique design that will permit selective recycling of the combustion products flowing through the apparatus to achieve complete thermal destruction of contaminants.

Another object of the invention is to provide an apparatus for thermal destruction of industrial waste contaminates which is both efficient and reliable in operation, is of simple design, and can be economically constructed and operated.

DESCRIPTION OF THE INVENTION

Figure 1:
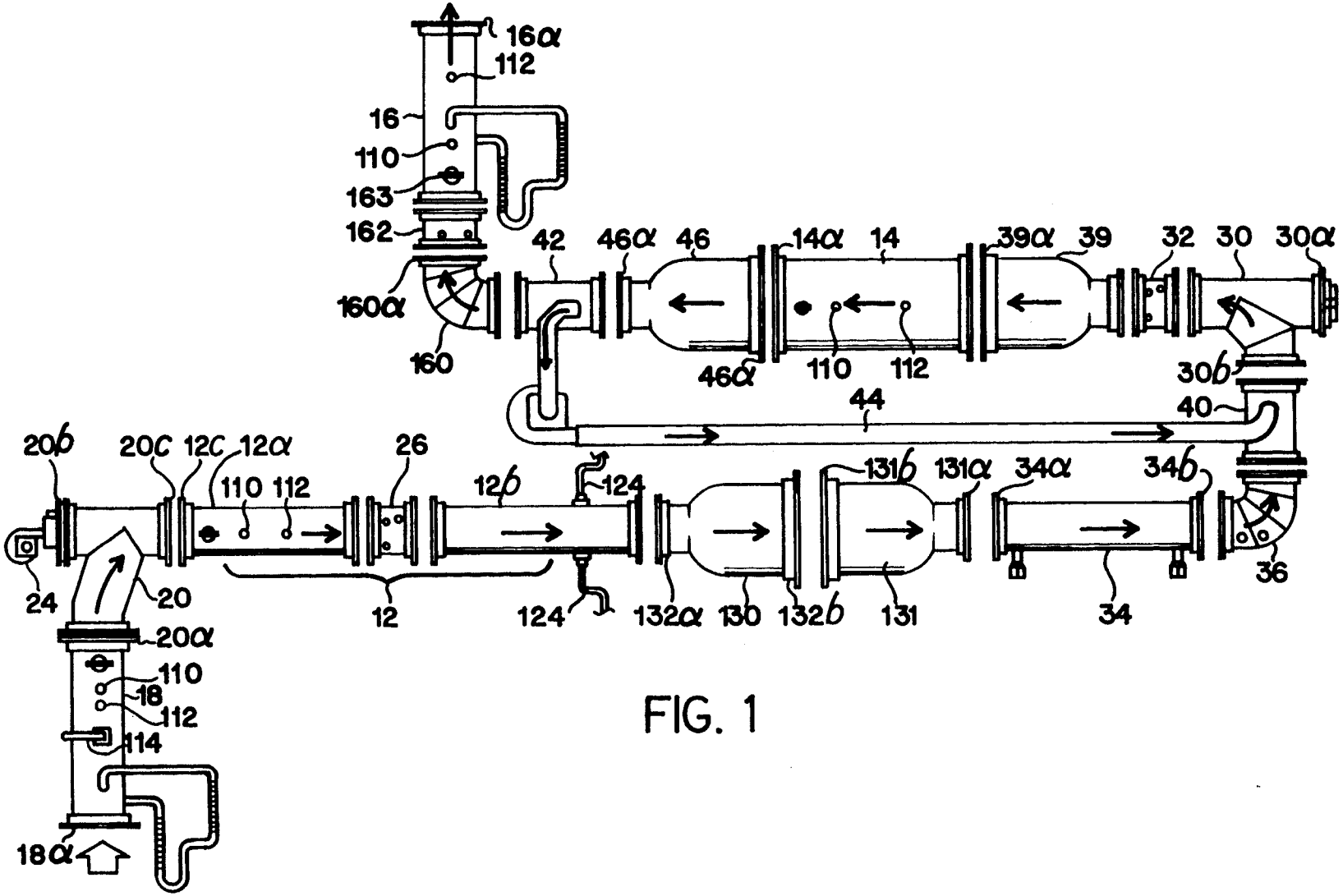
FIG. 1 is an exploded plan view of one form of the apparatus of the invention.

Referring to the drawings and particularly to FIG. 1, one form of the apparatus for pyrolyzing waste materials comprises three, spaced-apart, generally cylindrical shaped, interconnected combustion chambers 12, 14 and 16 and first inlet means for introducing gaseous waste materials into the apparatus. In the present form of the invention, the inlet means comprises a generally cylindrically shaped section 18 and a generally T-shaped section 20 which is interposed between section 18 and first combustion chamber 12.

As indicated in FIG. 1, first combustion chamber 12 comprises two portions 12*a* and 12*b*, which are separated by the first injection means of the invention for injecting combustible gases such as a mixture of hydrogen and oxygen into portion 12*b* of the first combustion chamber 12. Gaseous hydrocarbons such as natural gas and propane can also be introduced into the system via the injection means. Disposed adjacent portion 12*b* of combustion chamber 12 is a first reducing means for reducing the diameter of the size of the flow path of the gases flowing toward second combustion chamber 14. The details of construction of this first reducing means will presently be described.

In the embodiment of the invention illustrated in the drawings, the contaminate-bearing waste gases to be treated are introduced into T-section 20 through a first port 20*a*.

Introduced into a second port 20*b* of section 20 is a burning gas produced by a natural gas or propane burner generally designated in FIG. 1 by the numeral 24. Burner 24 is of conventional construction and generates a blast of burning gas which is located inwardly of portion 12*a* of the combustion chamber. More particularly, the blast of burning natural gas or propane enters member 20 through port 20*a*, exits member 20 through outlet port 20*c* and then enters portion 12*a* of the first combustion chamber 12 via inlet port 12*c*. In the present embodiment, gas burner 24 comprises a part of the ignition means of the invention for igniting the natural gas as well as the mixture of hydrogen and oxygen introduced into combustion chamber 12*b* by the first injection means which is here provided in the form of an annular shaped injector member 26 which is disposed intermediate sections 12*a* and 12*b* of combustion chamber 12. The details of construction of this important injector member 26 will presently be described.

In a modified embodiment, the burner 24 may be omitted and be replaced by an air-blast pre-purge (to remove resident ignitable gases prior to initial ignition or restraint). A similar arrangement is also possible in the primary combustion chamber 12 if it fired by an injection member 26 instead of (conventional) atmospheric air/hydrocarbon fuel. This enables a single air blower to purge both chambers.

Connected downstream of the first reducing means of the invention is a first expansion means which receives the first combustion product, or pyrolyzed product, produced in combustion chamber 12 as a result of the pyrolyzation of the waste gases. This means functions to permit the controlled expansion of the gases along the gas flow path or the apparatus. Connected to the expansion means is a cooling means for cooling the first pyrolyzed or combustion product which is produced in combustion chamber 12. After cooling, the pyrolyzed product can, in some cases, be vented directly to atmosphere. In other instances, it is necessary to subject the pyrolyzed product to further treatment before its release to atmosphere. The apparatus shown in FIG. 1 contemplates this further treatment of the pyrolyzed gases and, therefore, the pyrolyzed product after passing through the cooling means is introduced into a second injector means here comprising a generally T-shaped section 30. This second injector means functions to introduce into the flow path a selected mixture of combustible gases. Section 30 also functions to direct the pyrolyzed products flowing from the cooling means into second combustion chamber 14 via a third injection means shown here as an annular shaped injector 32, which is of identical construction to injector member 26. Disposed intermediate T-shaped section 30 and the cooling means, which here comprises a generally cylindrically shaped section 34 is an elbow 36 and a portion of the recirculation means of the invention, the construction of which will be described in the paragraphs which follow.

Within combustion chamber 14, the pyrolyzed products flowing from the first combustion chamber are further pyrolyzed to secondarily treat contaminants that may remain within the pyrolyzed product emanating from the first combustion chamber. To assist in this second pyrolyzation step, the second injector means can be used to introduce a selected mixture of chemicals and combustible gases into the second combustion chamber as determined by the needs of the process via an inlet port 30*a* of T-shaped section 30. In a manner presently to be described, the gases introduced into inlet port 30*a* of flow through third injection means, or refractor ring 32 and an expansion means or expansion section 39 prior to reaching combustion chamber 14.

An important feature of the apparatus of the present invention comprises recirculation means for recirculating back to the second combustion chamber to the pyrolyzed product flowing out of the second combustion chamber 14. The recirculation means here comprises first and second recirculation sections 40 and 42 and a flow conduit 44 which interconnects sections 40 and 42 in the manner shown in FIG. 1. Section 40 is disposed between elbow 36 and inlet port 30*b* of section 30, while section 42 is interconnected to the outlet port of a second reducing means or reducing section 46.

Figure 16:
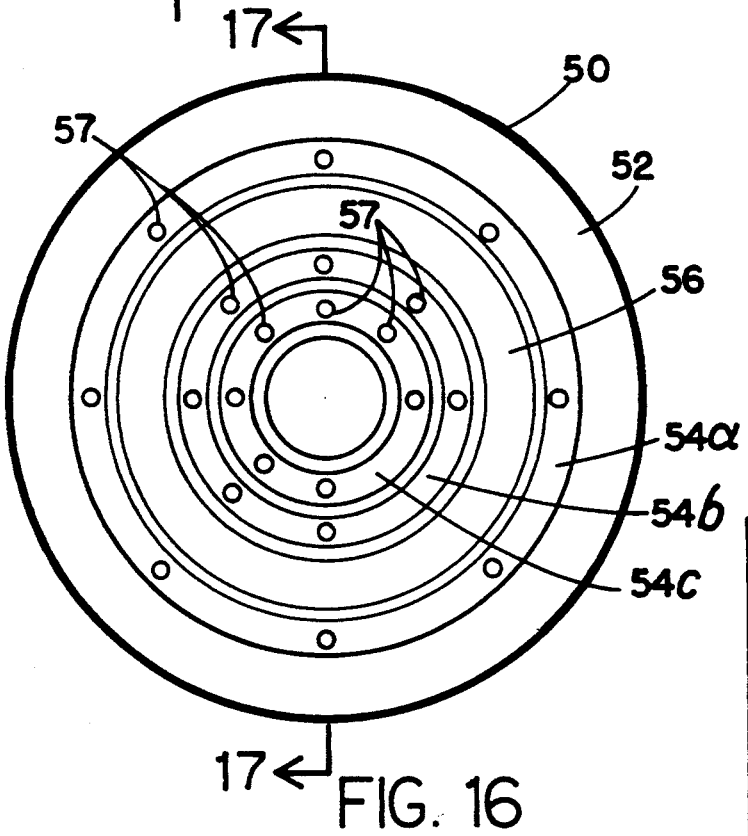
FIG. 16 is a front view of the flat face injector component of the assembly of FIG. 1.
Figure 17:
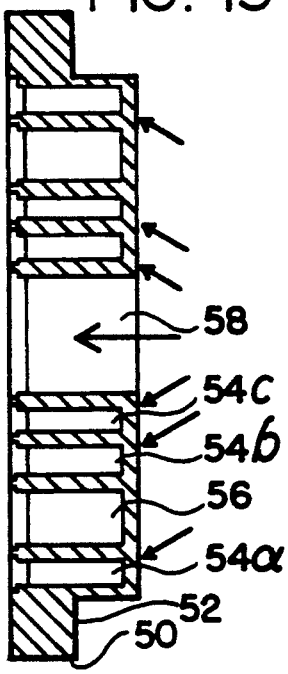
FIG. 17 is a cross-sectional view taken along lines 17—17 of FIG. 16.

The second injection means of the invention for injecting the selected mixture of chemicals and combustible gases into the system here comprises a flat face injector assembly 50 which is connected to inlet port 30*a* of member 30. As best seen in FIGS. 16 and 17, injector assembly 50 comprises a stainless steel injector plate 52 having three circular gas manifold injectors 54*a*, 54*b*, 54*c*, a circular waste channel 56 and a centre hole or injection port 58. Centre hole injection port allows the injection of compressed air, if needed, to introduce into the system selected materials such as iron, dust or pulverised coal, which function to enhance hydrogen formation. Gases flowing through manifolds 54*a*, 54*b* and 54*c* are injected into member 30 via a multiplicity of circumferentially and radially spaced inlets generally designated in FIG. 16 by the number 57. If the pyrolyzed products flowing from chamber 14 are recycled via the previously-mentioned recycling means, that is from recycling section 42 to recycling section 40 via conduit 44, these recycled pyrolyzed products are further pyrolyzed within chamber 14 by the mixture of hydroxy gases introduced by ring injector 32 and mixture of selected chemicals and gases introduced into the system via the flat face injector assembly.

Following the further pyrolyzation of the pyrolyzed product within chamber 14, the product thus formed can, under some circumstances, be introduced to atmosphere, or alternatively be directed toward the previously identified third combustion chamber 16 for still further pyrolyzation, in a manner presently to be described, to make this determination. The pyrolyzed product flowing outwardly from combustion chamber 14 is carefully analyzed by appropriate sensor means to determine the level of contaminants present within the waste product or pyrolyzed product flowing outwardly of chamber 14. Similarly, pyrolyzed product flowing outwardly of combustion chamber 16 is carefully analyzed using appropriate sensor means to determine the level of contaminates present in the gas flow. When the product meets acceptable levels of contamination, the finally treated product is released into atmosphere through suitable outlet means, here shown as an outlet port 16*a* of third combustion chamber 16.

Figure 6:
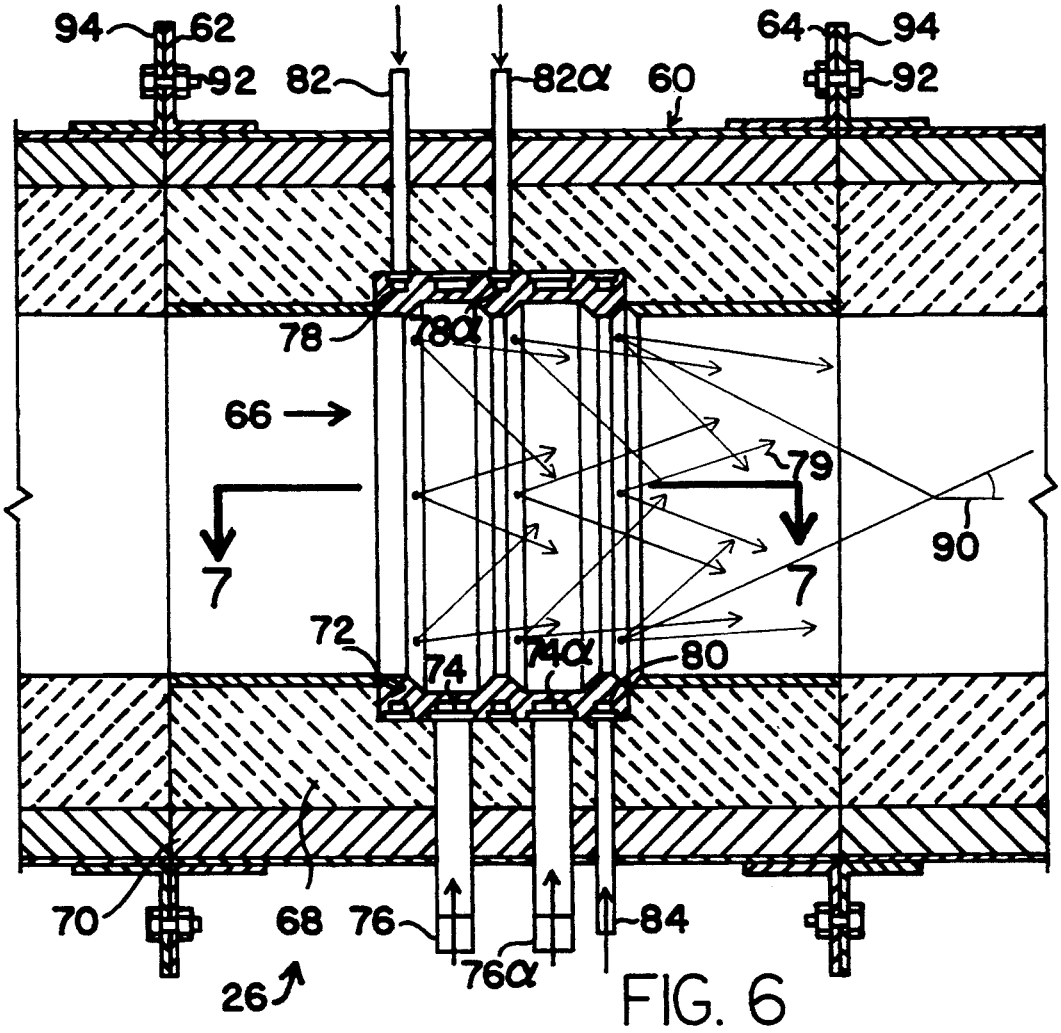
FIG. 6 is a greatly enlarged cross-sectional view of the injector means or ring injector assembly of the apparatus.
Figure 7:
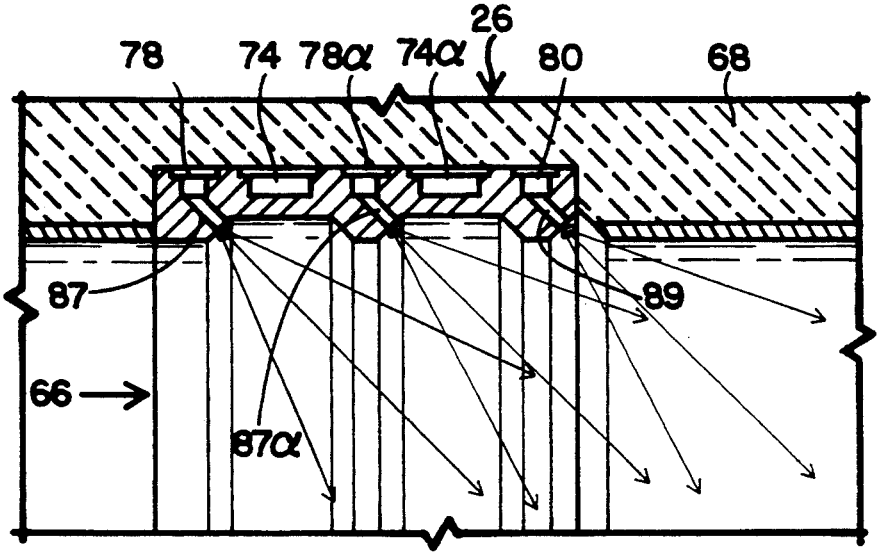
FIG. 7 is an enlarged cross-sectional view taking along lines 7—7 of FIG. 6.

Turning now to FIGS. 6 and 7, the important first injection means of the invention for injecting hydrogen and oxygen gas into the first combustion chamber is there illustrated. The injection means in FIGS. 6 and 7 is identical to the third injection means identified in FIG. 1 by the numeral 32 and the description of the injector assembly 26, which follows, also describes the construction of injector assembly 32. The injector assembly in both cases comprises a cylindrically shaped steel casing 60 having connector flanges 62 and 64 affixed to each end by any suitable means such as welding. The ring injector assembly 66 is supported generally centrally of casing 60 by a cast refractory material of a character well known to those skilled in the art. Surrounding refractory material 68 is a suitable insulation material 70 which may be glass wool, carbon, graphite or any other suitable high-temperature insulation material.

As best seen in FIG. 6, injector assembly 66 comprises an annular shaped, steel injector ring 72 having circumferentially extending first and second water circulating passageways or channels 74, 74A, cooling water conduits 76, 76A, which are in communication with channel 74, 74A extend through the refractory material, the insulation, and the outer casing so that they can be interconnected with a suitable external source of cooling water. As can be seen by also referring to FIG. 7, ring 72 is also provided with first, second and third circumferentially extending gas passageways 78, 78A and 80. Gas passageways 78, 78A are interconnected with gas conduits 82, 82A which extend through refractory material 68, insulation material 70 and outer casing 60 for interconnection with suitable sources of hydrogen and oxygen. Passageway 80 is similarly interconnected with a gas conduit 84 which extends through refractory 68, insulation layer 70 and outer casing 60 for interconnection with the source of hydrocarbon gas, e.g. natural gas, propane. It is to be understood that the source of gas for passageways 78, 78A may be a mixture of hydrogen and oxygen, i.e. hydroxy gas.

The gas flowing through gas passageways 78, 78A and 80 is uniquely injected into the interior of the injection means via a plurality of circumferentially spaced angularly inwardly extending gas passageways. These passageways are identified in FIG. 7 by the numerals 87, 87A and 89. Passageways 87, 87A and 89 communicate with circumferentially extending gas passageways 78, 78A and 80, respectively. As best seen in FIG. 6, gas passageways 87, 87A and 89 are uniquely angled so that gas flowing through passageways 78, 78A and 80 is directed inwardly of the injection means in a generally conically shaped pattern of the character depicted by the arrows 79 of FIG. 6. This geometrical configuration provides optimum impingement for the efficient injection of the gases into the flow path of the gaseous waste flowing into portion 12*b* of combustion chamber 12. This optimum impingement angle is designated in FIG. 6 by the numeral 90 and preferably is in the order of about 25 degrees relative to the longitudinal axis of the injector ring. It is important to recognize that the injector means of the invention can be used to inject any desired gaseous mixture into the apparatus and is not limited to the injection of clean hydrogen, oxygen (or hydroxy) and/or hydrocarbon. gases.

As previously mentioned, and as clearly shown in FIG. 6, the first injector means is disposed intermediate first and second portions of combustion chamber 12 and is interconnected therewith by suitable connectors 92 which interconnect flanges 62, 64 with mating flanges 94 provided on the first and second portions of combustion chamber 12 (FIG. 6). Flanges of the character shown in FIG. 6 are provided proximate the ends of the outer steel casings of all of the various components of the assembly shown in FIG. 1 and connectors such as connectors 92 are used to interconnect the components which make up the assembly.

Figure 2:
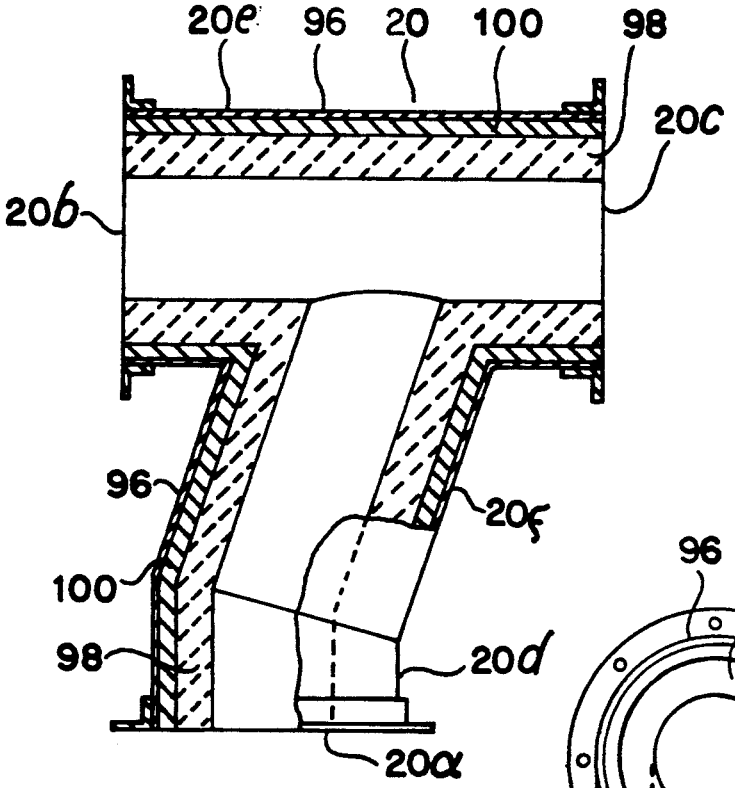
FIG. 2 is a cross-sectional view of one of the inlet sections of the apparatus.
Figure 3:
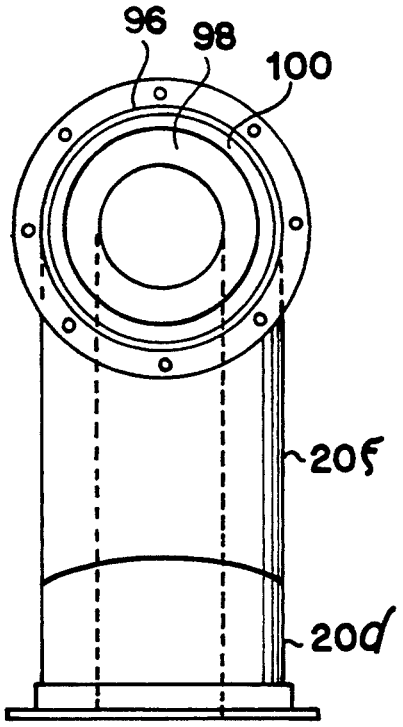
FIG. 3 is an end view of the section shown in FIG. 2.

Turning now to FIGS. 1, 2 and 3, the construction of the previously mentioned three-way blast section or generally T-shaped member 20 shown in FIG. 1 is illustrated in greater detail in FIGS. 2 and 3. This member functions to introduce into the system the waste emissions from an oven, kiln or like Mission producing device (not shown) which is suitably interconnected with inlet port 18*a* of member 18. Member 18 is, in turn, connected to inlet 20*a* of member 20 in the manner shown in FIG 1. Preferably, member 20 is of the configuration shown in FIGS. 2 and 3 and comprises a vertical section 20*d* which is connected to a horizontal section 20*e* via a diagonal section 20*f* (FIG. 2). The preferred angle of connection of sections 20*b* and 20*f* is approximately 30 degrees. Ends 20*a*, 20*b* and 20*c* are flanged in the manner previously described for easy assembly to the other previously-mentioned components of the apparatus of the invention.

As was the case with the injection means or section 26 of the invention, the three-way blast section 20 comprises an outer steel casing 96, an inner refractory layer 98 and an insulation layer 100. The gas flow path of this component is defined by the interior passageways of refractory lining 98. As previously mentioned, gas burner 24 is connected to port 20*b* of member 20, while straight section member 18 is connected to inlet port 20*a* of member 20.

Figure 4:
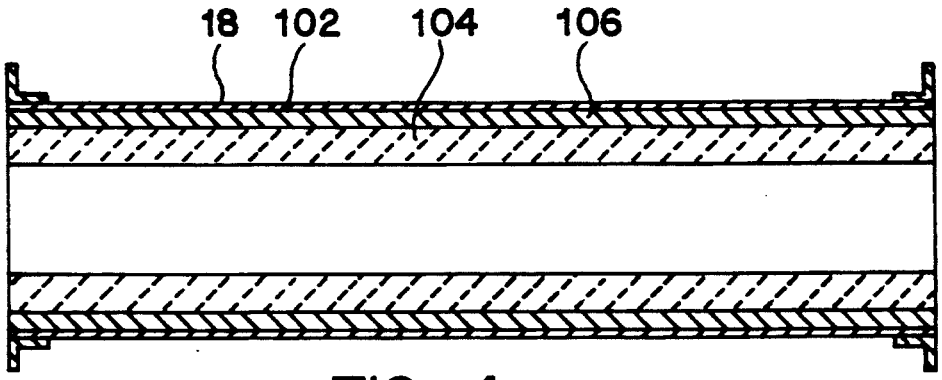
FIG. 4 is a cross-sectional view of another of the inlet sections of the apparatus of FIG. 1.
Figure 5:
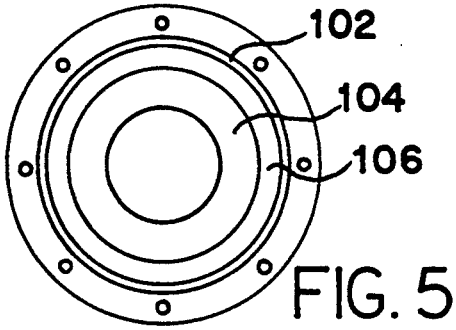
FIG. 5 is an end view of the section shown in FIG. 4.

Referring to FIGS. 4 and 5, inlet section 18 is generally cylindrical in shape, is flanged at both ends and comprises and outer steel casing 102. Disposed within casing 102 is a refractory layer 104 and an insulation layer 106 of the character previously described. The flanged ends of section 18 permit it to be readily interconnected with the flange provided at inlet 20*a* of member 20 and also with the outlet of the source of waste gas emissions such as oven, kiln or the like. As best seen in FIG. 1, section 18 is also provided with probe ports 110 and 112 which can receive selected sensor means in the form of sensing probes for monitoring the pollution or contaminate levels and the temperature levels of the gases flowing into section 18 from the source of the waste gases. These probes or sensor means are of a character well known to those skilled in the art and are readily commercially available. Proximate one end of section 18, there is also provided a butterfly actuated valve 114 for controlling the rate of flow of waste gases toward the first combustion chamber. Butterfly valve 114 is also of a type well known to those skilled in the art and, accordingly, the details of construction thereof will not be herein described.

The first portion 12*a* of combustion chamber 12 also has a configuration similar to section 18 as shown in FIGS. 4 and 5. More particularly, portion 12*a* is lined with a refractory material and an insulating material and includes an outer steel casing—all of the character previously described. Additionally, section 12*a* is provided with probe ports 110 and 112 for receiving suitable sensor means or sensor probes for measuring contamination levels and temperature levels of the waste gases flowing through portion 12*a* of the combustion chamber.

Figure 8:
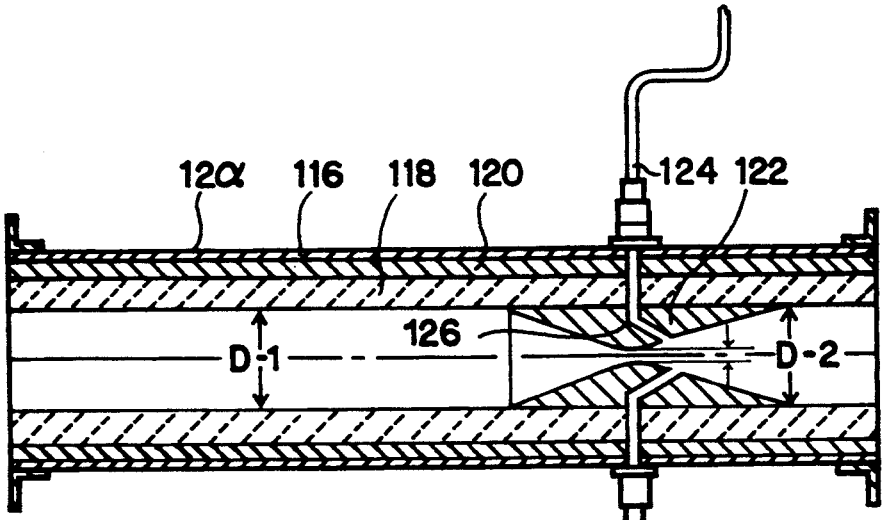
FIG. 8 is a cross-sectional view of the reducing means or reducing throat section of the assembly of FIG. 1.
Figure 9:
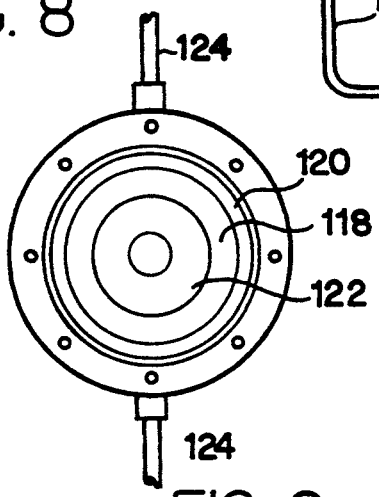
FIG. 9 is an end view of the throat section shown in FIG. 8.

Turning now to FIGS. 8 and 9, the construction of the second portion 12*b* of the combustion chamber and of the first reducing means of the invention is there shown. The construction of portion 12*a* is similar to that of the previously described section components and includes an outer steel casing 116, an inner refractory lining 118, and an intermediate insulation lining 120. Portion 12*a* is flanged at both ends for easy interconnection with the adjacent components of the apparatus in the manner shown in FIG. 1. An important aspect of the apparatus of the invention, as shown in FIG. 8, is the reducing means, which is here provided as a reducing throat section 122. Section 122 is disposed interiorly of the gas flow passageway of section 12*a* and is preferably constructed of a rigid carbon or graphite material having the generally necked down configuration shown in FIG. 8. As previously mentioned, the reducing means or graphite section 122 functions to reduce the size of the gas flow path from a diameter designated in FIG. 9 as D1 to a diameter proximate the centre of the throat portion 22 which is designated as D2. This reducing means functions to increase the speed of the gases flowing through diameter D2. At the same time, means for introducing combustible gases into throat portion increases the temperature of the gases flowing outwardly of throat section 122. This latter means here comprises a pair of injectors 124 which are disposed on opposite sides of throat member 122 in the manner best seen in FIG. 8. Injectors 124 are connected with a suitable source of combustible gas such as hydroxy gas or a mixture of hydroxy gas and natural gas and include inlet passageways 126 which extend through casing 116, insulation layer 120, refractory layer 118 and graphite throat section 122. As bet seen in FIG. 8, passageways 126 are strategically configured so as to cause gas to flow angularly inwardly into the reduced diameter gas flow path D2.

Figure 10:
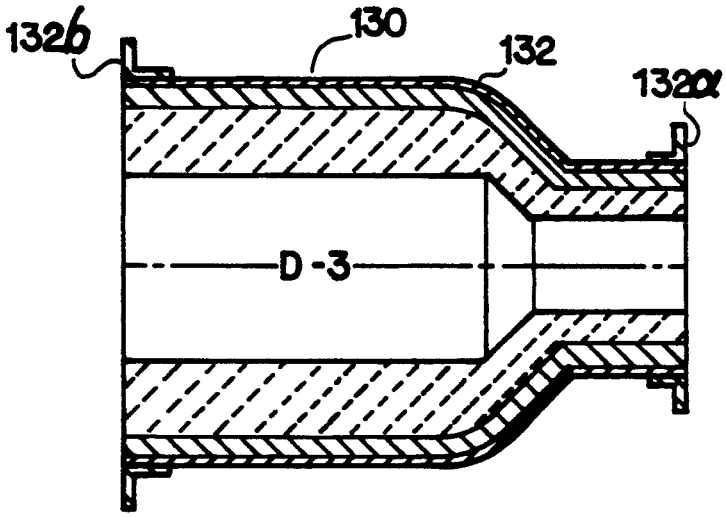
FIG. 10 is a cross-sectional view of the expansion section of the assembly in FIG. 1.
Figure 11:
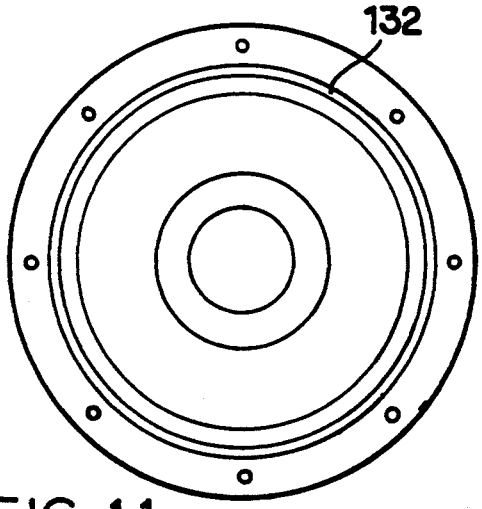
FIG. 11 is an end view of the expansion section of FIG. 10.

Connected downstream of reducing means or throat section 122 is an expansion means for increasing the size of the flow path from D2 to approximately D3 (FIG. 10). Referring to FIGS. 10 and 11, the first expansion means of the invention is there shown and comprises a generally bel-shaped section 130 which includes an outer steel casing 132 which is flanged at both ends for interconnection with adjacent components. The smaller diameter flanged end 132*a* of section 130 interconnects with portion 12*b* of combustion chamber 12 in the manner indicated in FIG. 1. The larger diameter flanged end 132*b* of section 132 interconnects with a similar configured section identified in FIG. 1 by the numeral 131. Section 131 is of identical construction to section 132 and includes a flanged end 131*b* which is interconnected with flanged end 132*b* of section 130. Smaller diameter flanged end 131*a* of section 131 is, in turn, interconnected with end 34*a* of the cooling means of the invention shown here as heat exchanger assembly 34. Sections 130 and 131 both includes refractory and insulation liners of the character previously described and as shown in FIGS. 10 and 11.

Figure 14:
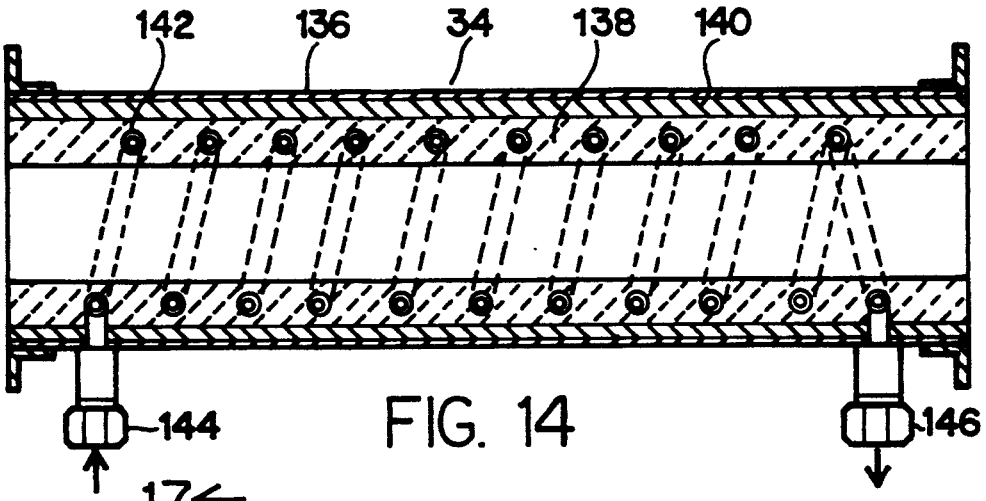
FIG. 14 is a cross-sectional view of the cooling means or heat exchanger section of the assembly in FIG. 1.
Figure 15:
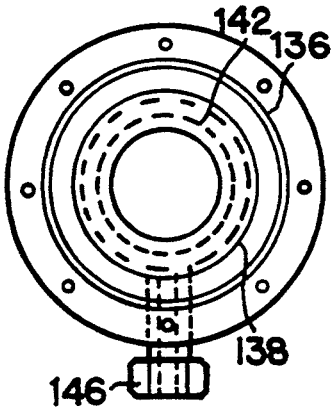
FIG. 15 is an end view of the section shown in FIG. 14.

Referring now to FIGS. 14 and 15, the cooling means or heat exchanger section of the apparatus comprises an outer steel casing 136 which is flanged on either end. Disposed internally of casing 136 is an inner refractory layer 138 and an insulation layer 140, both of a character previously described herein. Carried internally of refractory material 138 is an elongated water carrying coil 142 having a plurality of longitudinally spaced coils extending along the length of heat exchanger section 34. A water inlet 144 is connected at one end of coil 142 while a water outlet connector 146 is connected at the opposite end of coil 142. Water flowing through coil 142 will tend to cool the waste gases or pyrolyzed product flowing from combustion chamber 12. The water flowing through coil 142 will be heated by the hot gases flowing along the flow path and, in one form of the invention, can be used to preheat the hydrogen gas before its injection into the system, thereby gaining kinetic energy. In like manner, the heated water flowing through coil 142 can be used for a variety of heating purposes.

Figure 12:
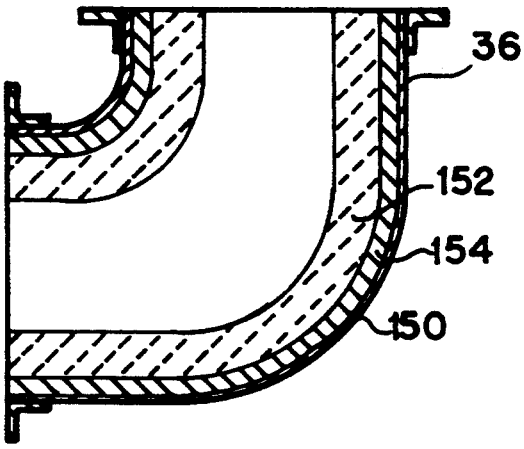
FIG. 12 is a cross-sectional view of one of the 90 degree elbow components of the assembly of FIG. 1.
Figure 13:
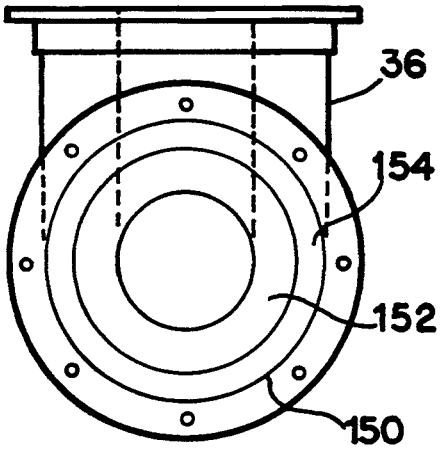
FIG. 13 is an end view of the elbow shown in FIG. 12.

As indicated in FIG. 1, end 34*b* of heat exchanger 34 is interconnected with previously mentioned elbow 36, the configuration of which is illustrated in FIGS. 12 and 13. Elbow 36, like the previously described component of the apparatus, includes an outer steel casing 150 which carries an inner refractory lining 152 and an insulation layer 154. Steel casing 150 is appropriately flanged at either end for interconnection with adjacent components of the assembly in the manner shown in FIG. 1. Disposed intermediate elbow 36 and T-shaped member 30 is the previously identified recycling recirculating component 40.

In operation, gases flowing from the heat exchanger section 34 as well as gases flowing from recirculating section 42 are introduced into combustion chamber 14 via expansion unit 39 which is of the same construction as the sections illustrated in FIGS. 10 and 11 and designated by the numerals 130 and 131.

As indicated in FIG. 1, the output end 39*a* of expansion section 39 is connected to second combustion chamber 14. Similarly, the output end 14*a* of combustion chamber 14 is connected to the in-put end 46*a* of yet another reducing means generally designated in FIG. 1 by the numeral 40. Reducing means, or section 46 is also of identical construction to that shown in FIGS. 10 and 11 and function to reduce the diameter of the gas flow path as the gas flows from second combustion chamber 14 into section 42 and thence into recirculation section 42. As previously mentioned, second combustion chamber 14 is provided with sensor probe ports 110 and 112 to receive sensors adapted to measure contamination and temperature levels of the gases flowing through the combustion chamber. In those instances where analysis of the gases indicate that recycling is not necessary, the pyrolyzed product flowing from combustion chamber 14 will flow directly into an elbow 160 which is of the same construction illustrate in FIGS. 12 and 13 and previously described herein. The outlet 160*a* of elbow 160 is connected to a four injector means 162 which is disposed between elbow 160 and third combustion chamber 16. Injector section 162 is of identical construction to the injector assembly shown in FIGS. 6 and 7 and functions to introduce a mixture of hydroxy gas or a mixture of hydroxy gas and gaseous hydrocarbons into third combustion chamber 16. Third combustion chamber 16 is also provided with probe ports 110 and 112 which receive appropriate sensor probes to enable measurement of contaminate and temperature levels of pyrolyzed product flowing through combustion chamber 16. If the pyrolyzed gas flowing through combustion chamber 16 meets required environmental standards, it is expelled to atmosphere. If the levels of contaminates exceed those permitted by applicable environmental standards, a butterfly valve 163 provided on combustion chamber 16 is immediately closed down and the pyrolyzed product flowing from second chamber 14 is recycled through the recycling means which has previously been described.

The pyrolyzed product flowing from combustion chamber 14 can be recyclyed as many times as necessary to ensure that the levels of contamination are below prescribed levels before the products are released to atmosphere through outlet means 16*a*.

It is to be understood that depending upon the waste materials to be treated, a wide variety of combustible gases can be used to pyrolyze the waste materials. Similarly, various chemicals can be added to the gas flow via injector assembly 50. The sensor means of the apparatus of the invention which are strategically located within the various interconnected sections of the apparatus can be used to closely monitor contamination levels of the gas flow as it flows through the system and thereby continuously guard against introduction to atmosphere of contaminates exceeding specified levels.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. An apparatus for thermal destruction of waste, comprising:

(a) a first combustion chamber;

(b) inlet means for introducing waste into said first combustion chamber;

(c) first injection means for injecting a mixture of hydrogen and oxygen into said first combustion chamber, said first injection means comprising an annular-shaped injector member having:

(i) a first circumferentially extending water circulating passageway for circulating cooling water through said injector member;

(ii) first and second circumferentially extending gas passageways for respectively directing flow of hydrogen and oxygen around said injector member; and (iii) a plurality of circumferentially spaced angularly inwardly extending first and second gas passageways in communication with said first and second circumferentially extending gas passageways for respectively directing the flow of said hydrogen and oxygen inwardly of said injector member in a substantially conically shaped pattern;

(d) ignition means located in the first chamber for igniting said hydrogen and oxygen, whereby the waste introduced into said first combustion chamber is pyrolyzed to produce a pyrolyzed product; and (e) outlet means for expelling said pyrolyzed product from the first chamber.

2. An apparatus as defined in claim 1 in which said injector member further includes a third circumferentially extending gas passageway for directing flow of a mixture of hydrocarbon gas around said injector member; and a plurality of circumferentially spaced, angularly inwardly extending gas passageways in communication with said third circumferentially extending gas passageway for directing the flow of the hydrocarbon gas inwardly of said injector member in a substantially conically shaped pattern;

said first water circulating passageway being disposed intermediate said first and second gas passageways; and a second circumferentially extending water circulating passageway being disposed intermediate said second and third gas passageways.

3. An apparatus as defined in claim 1 further including sensor means for sensing temperatures affixed within said first combustion chamber and for sensing the level of contaminates contained within the pyrolyzed waste.

4. An apparatus as defined in claim 1 and further including a second combustion chamber disposed between said first combustion chamber and said outlet means and configured for receiving gases flowing from said first combustion chamber along a flow path extending between said first and second chambers.

5. An apparatus as defined in claim 4 and further including second injection means connected to said second combustion chamber for injecting into said second combustion chamber selected gaseous and particulate materials.

6. An apparatus as defined in claim 5 and further including reducing means disposed intermediate said first and second combustion chambers for reducing the size of the said flow path at a location intermediate said first and second combustion chambers.

7. An apparatus for thermal destruction of waste, comprising:

(a) a first combustion chamber;

(b) inlet means for introducing waste into said first combustion chamber;

(c) first injection means for injecting a mixture of hydrogen and oxygen into said first combustion chamber, said first injection means comprising an annular-shaped injector member having:

(i) a first circumferentially extending water circulating passageway for circulating cooling water through said injector member;

(ii) first and second circumferentially extending gas passageways for respectively directing flow of hydrogen and oxygen around said injector member; and (iii) a plurality of circumferentially spaced angularly inwardly extending first and second gas passageways in communication with said first and second circumferentially extending gas passageways for respectively directing the flow of said hydrogen and oxygen inwardly of said injector member in a substantially conically shaped pattern;

(d) ignition means located in the first chamber for igniting said hydrogen and oxygen, whereby the waste introduced into said first combustion chamber is pyrolyzed to produce a pyrolyzed product;

(e) outlet means for expelling said pyrolyzed product from the first chamber;

(f) a second combustion chamber disposed between said first combustion chamber and said outlet means and configured for receiving gases flowing from said first combustion chamber along a flow path extending between said first and second chambers;

(g) a second injection means connected to said second combustion chamber for injecting into said second combustion chamber selected gaseous and particulate materials;

(h) a reducing means disposed intermediate said first and second combustion chambers for reducing the size of the said flow path at a location intermediate said first and second combustion chambers; and (i) means for introducing combustible gases into said flow path at said intermediate, reduced size location.

8. An apparatus for thermal destruction of waste, comprising:

(a) a first combustion chamber;

(b) inlet means for introducing waste into said first combustion chamber;

(c) first injection means for injecting a mixture of hydrogen and oxygen into said first combustion chamber, said first injection means comprising an annular-shaped injector member having:

(i) a first circumferentially extending water circulating passageway for circulating cooling water through said injector member;

(ii) first and second circumferentially extending gas passageways for respectively directing flow of hydrogen and oxygen around said injector member; and (iii) a plurality of circumferentially spaced angularly inwardly extending first and second gas passageways in communication with said first and second circumferentially extending gas passageways for respectively directing the flow of said hydrogen and oxygen inwardly of said injector member in a substantially conically shaped pattern;

(d) ignition means located in the first chamber for igniting said hydrogen and oxygen, whereby the waste introduced into said first combustion chamber is pyrolyzed to produce a pyrolyzed product;

(e) outlet means for expelling said pyrolyzed product from the first chamber;

(f) a second combustion chamber disposed between said first combustion chamber and said outlet means and configured for receiving gases flowing from said first combustion chamber along a flow path extending between said first and second chambers;

(g) a second injection means connected to said second combustion chamber for injecting into said second combustion chamber selected gaseous and particulate materials;

(h) a reducing means disposed intermediate said first and second combustion chambers for reducing the size of the said flow path at a location intermediate said first and second combustion chambers; and (i) expansion means located intermediate said reducing means and said second combustion chamber for increasing the size of said flow path at a location intermediate said reducing means and said second combustion chamber.

9. An apparatus as defined in claim 6, further including means for introducing natural gas into said first chamber.

10. An apparatus for thermal treatment of gaseous emissions comprising:

(a) a first combustion chamber having a first diameter;

(b) inlet means for introduction of gaseous emissions into said first combustion chamber for flow therethrough;

(c) first injection means for injecting hydrocarbon gas, hydrogen and oxygen into said first combustion chamber in a substantially conically shaped pattern to thermally treat the emission gases and form a first combustion product;

(d) reducing means connected to said first combustion chamber for receiving said first combustion product, said reducing means including a throat section having a second diameter less than said first diameter of said first combustion chamber;

(e) first expansion means connected to said reducing means for receiving said first combustion product, said expansion means having a diameter greater than the diameter of said throat section of said reducing means;

(f) cooling means connected to said expansion means for cooling said first combustion product to form a cooled product;

(g) a second combustion chamber having a first diameter connected to said cooling means;

(h) second injection means connected to said second combustion chamber for injecting into said second combustion chamber a selected mixture of gases to form a combustible mixture;

(i) third injection means connected to said second combustion chamber for injecting hydrocarbon gas, hydrogen and oxygen into said second combustion chamber in a substantially conically shaped pattern to thermally treat said combustible mixture and to form a second combustion product; and (j) outlet means for expelling said second combustion product to atmosphere.

11. An apparatus as defined in claim 10 in which said throat section of said reducing means includes means for injecting a selected combustible gaseous mixture into said first combustion product.

12. An apparatus as defined in claim 10 and further including sensor means disposed intermediate said second combustion chamber and said outlet means for measuring the level of contaminates in said second combustion product.

13. An apparatus as defined in claim 12, including recirculating means disposed intermediate said second combustion chamber and said outlet means for selectively recirculating said second combustion product through said second combustion chamber.

14. An apparatus as defined in claim 12 and further including a third combustion chamber disposed intermediate said second combustion chamber and said outlet means.

15. An apparatus as defined in claim 14 and further including fourth injection means for injecting a mixture of hydrocarbon gas, hydrogen and oxygen into said third combustion chamber.

16. An apparatus as defined in claim 15 and further including means for introducing natural gas into said first combustion chamber.

17. An apparatus as defined in claim 15 in which said second injection means includes means for selectively injecting a particulate material into said second combustion chamber to enhance oxidation.

18. An apparatus for pyrolyzing waste materials comprising:

(a) a first substantially cylindrical combustion chamber having a first diameter;

(b) inlet means for introducing waste and natural gas into said first combustion chamber;

(c) first injection means for injecting a mixture of hydrocarbon gas, hydrogen and oxygen into said first combustion chamber, said first injection means comprising an annular shaped injector member having:

(i) first, second and third spaced apart circumferentially extending gas passageways for respectively directing the flow of hydrogen, oxygen and hydrocarbon gas around said injector member;

(ii) two circumferentially extending water circulating passageways for circulating cooling water through said injector member, said water circulating passageways being disposed intermediate first and second, and second and third, said gas passageways, respectively; and (iii) a plurality of circumferentially spaced angularly inwardly extending gas passageways in respective communication with said first, second and third circumferentially extending gas passageways for directing the flow of the mixture of hydrogen, oxygen and hydrocarbon gas inwardly of said injector member in a substantially conically shaped pattern;

(d) ignition means located in the first chamber for igniting said hydrogen, oxygen and hydrocarbon gas, whereby the waste introduced into said first combustion chamber is pyrolyzed to produce a pyrolyzed product;

(e) first reducing means connected to said first combustion chamber for reducing the size of the flow passage through which the pyrolyzed product is flowing, said first reducing means including a throat section having a second diameter less than said first diameter of said first combustion chamber;

(f) first expansion means connected to said reducing means for receiving said first pyrolyzed combustion product, said expansion means having a diameter greater than the diameter of said throat section of said reducing means;

(g) cooling means connected to said expansion means for cooling said first pyrolyzed product to form a cooled product;

(h) a second combustion chamber having a first diameter connected to said cooling means;

(i) second injection means connected to said second combustion chamber for injecting into said second combustion chamber a selected mixture of combustible gases to form a combustible mixture;

(j) third injection means connected to said second combustion chamber for injecting hydrogen, oxygen and hydrocarbon gas, into said second combustion chamber in a substantially conically shaped pattern to pyrolyze said combustible mixture and to form a second pyrolyzed product;

(k) second expansion means connected to said second combustion chamber, said second expansion means having a diameter greater than said first diameter of said second combustion chamber;

(l) second reducing means connected to said second expansion means, said second reducing means having a diameter less than said diameter of said second expansion means;

(m) recirculation means connected to said second reducing means for recirculating said second pyrolyzed product through said second combustion chamber and (n) outlet means for expelling said second combustion product to atmosphere.

19. An apparatus as defined in claim 18 in which said throat section of said first reducing means includes means for injecting a selected gaseous mixture into said reducing means.

20. An apparatus as defined in claim 10 and further including sensor means disposed intermediate said second combustion chamber and said outlet means for measuring the level of contaminates in said second combustion product.

* * * * *